United States Patent [19]

Giebel

[11] 4,013,213

[45] Mar. 22, 1977

[54] POSTAL TRAY

[75] Inventor: Buddy E. Giebel, Monroe, Mich.

[73] Assignee: Union Camp Corporation, Wayne, N.J.

[22] Filed: Apr. 12, 1976

[21] Appl. No.: 675,741

[52] U.S. Cl. ..... 229/39 R
[51] Int. Cl.[2] ..... B65D 5/10
[58] Field of Search ..... 229/51 SL, 51 TL, 39 R

[56] References Cited

UNITED STATES PATENTS

| | | | |
|---|---|---|---|
| 2,737,338 | 3/1956 | Moore | 229/39 R X |
| 2,973,086 | 2/1961 | Thompson | 229/51 TC UX |
| 3,272,421 | 9/1966 | Perry | 229/39 R |
| 3,374,937 | 3/1968 | Wilson | 229/39 R |
| 3,539,090 | 11/1970 | Blasdell | 229/39 R X |
| 3,819,105 | 6/1974 | Heimann | 229/39 R |

*Primary Examiner*—Davis T. Moorhead
*Attorney, Agent, or Firm*—Kane, Dalsimer, Kane, Sullivan and Kurucz

[57] ABSTRACT

A tray adapted primarily for handling, shipping and sorting mail in which the top of the tray is provided with wide and narrow top closure flaps, such wide flap being formed of a wide and a narrow panel hinged together, the wide panel being positioned and dimensioned for folding downwardly against the side of the tray and the narrow panel being positioned for slipping under the bottom of the tray so that the wide closure flap is held out of the way to provide unobstructed access to the top of the tray for easy removal during the sorting of such mail.

2 Claims, 7 Drawing Figures

POSTAL TRAY

BACKGROUND IN THE INVENTION

This invention relates to improvements in trays and, more particularly, to a tray suited for handling mail. This container is formed from a collapsed and compact single piece blank which can be stored flat prior to use in a post office. It is adapted to be easily set up, without the need for any equipment, stitching or taping, into a generally rectangular tray with bottom and top closure flaps. The top closure flaps comprise a narrow and a wide flap with the wide flap formed of a wide and narrow panel, which wide flap can be easily folded out of the way and held in that position merely by slipping the narrow panel of the flap under the tray.

In the handling operation in the postal system, the mail is deposited in the tray prior to shipment to another location for sorting. The flaps of the tray pose little problem when the tray is being filled because such flaps can be easily held out of the way by hand. However, when the filled tray reaches the sorting station, the operator sorts the mail directly from the tray and needs two hands. It is at this stage that the tray of the present invention is particularly suitable. The wide panel of the wide top flap is positioned against the side panel of the tray with the narrow panel of such top flap under the bottom of the tray. It is retained in this position either by the weight of the contents of the tray or by placing the tray against the side of the sorting table. Thus, the mail can be removed from the tray and easily from an unobstructed top. For shipping the filled tray the top flap can be folded into a closed position and locked without the need for any equipment, stitching or taping.

U.S. Pat. No. 3,889,868 describes and claims a mail handling container with a cover provided with lock flaps which are inserted into pockets in the end walls of the container so that the cover can be held out of the way while the container is being filled. This requires end walls formed of double panels to provide the pockets for the lock flaps. Furthermore, it is necessary to use extra board to provide the lock flaps at the ends of the cover. In addition, the user of the container must perform an extra operation in inserting such lock flaps into the respective pockets.

The postal tray of the present invention is an improvement over the container of U.S. Pat. No. 3,889,868 and other known containers used for this purpose. It eliminates the need for lock flaps, double end walls and the operations connected therewith and serves the same purpose.

SUMMARY OF THE INVENTION

It is an object of the invention to provide a tray for holding, shipping and sorting mail formed from a single piece blank easily set up into a generally rectangular tray and provided with a top closure flap which is adapted to be folded and held out of the way during the sorting of the mail in the tray.

It is a further object to provide a blank which is simple and economical to manufacture and can easily be set up into a four-sided generally rectangular tray which is efficient and well-suited for its intended purpose.

BRIEF DESCRIPTION OF THE DRAWINGS

Other objects and advantages will become apparent from the following description which is to be taken in conjunction with the accompanying drawings, in which.

DESCRIPTION OF THE PREFERRED EMBODIMENT

Figure 1:
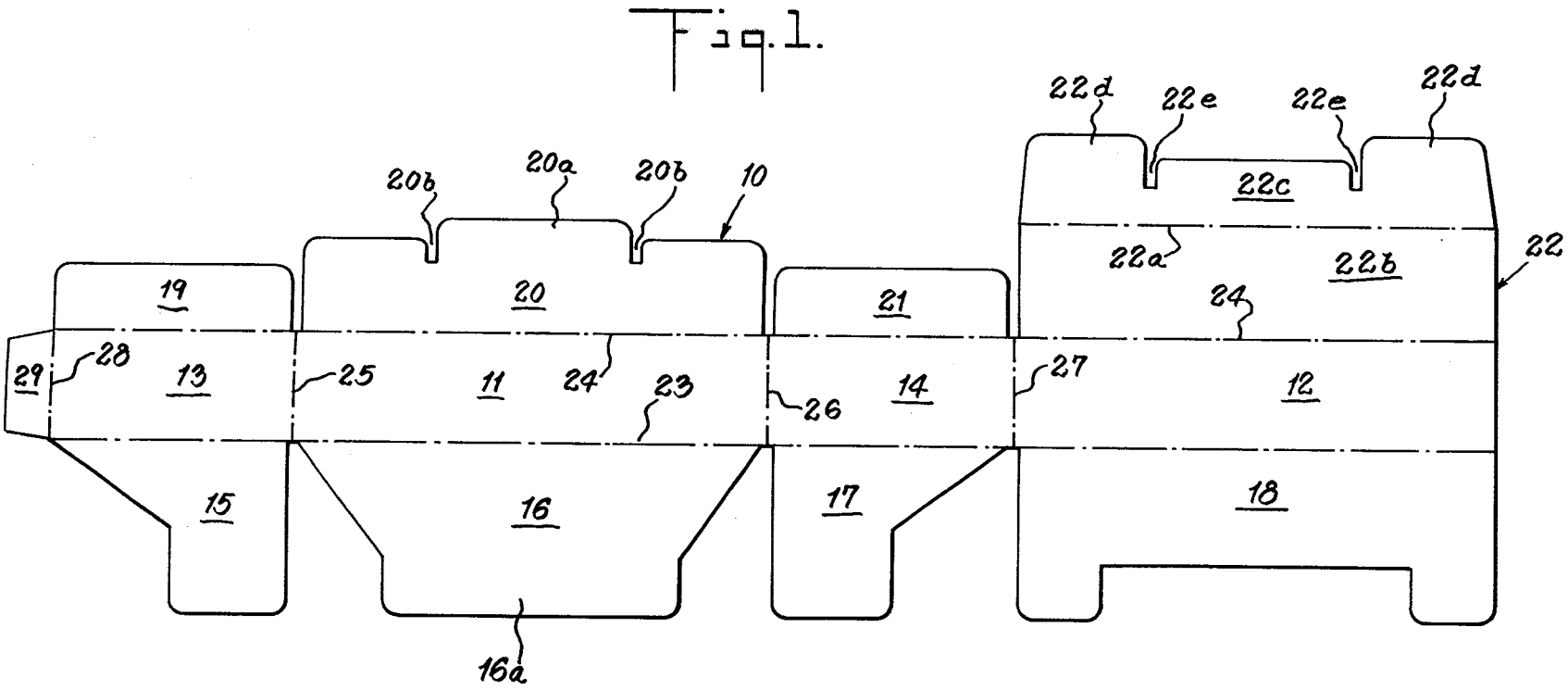
FIG. 1 is a plan view of the blank from which the tray of the present invention is formed.

Referring to the drawings, there is shown in FIG. 1 a flat blank 10 of sheet material, such as corrugated board, fiberboard or the like, of a weight suitable for the size and type of tray. The blank 10 consists of side panels 11 and 12, end panels 13 and 14, bottom flaps 15, 16, 17 and 18, and top flaps 19, 20, 21 and 22. The bottom flaps are attached to the side and end panels along a longitudinal score line 23. The top flaps are attached to the side and end panels along a longitudinal score line 24. The side panels and end panels are attached along score lines 25, 26 and 27. A score line 28 at one end of the blank defines a flap 29 which will be secured to the opposite end of the blank in forming the blank into a flat tube for shipment to customers and for storage prior to use. It will be understood that other forms of attachment or joint, such as tape, can be used.

Figure 2:
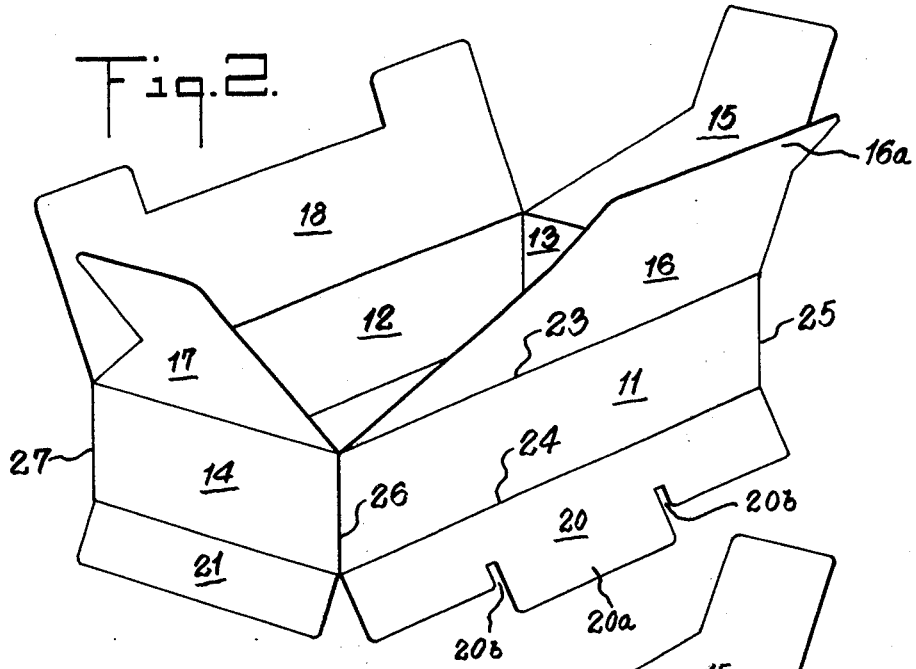
FIG. 2 is a perspective view of the blank of FIG. 1 partially set up into a tube.
Figure 3:
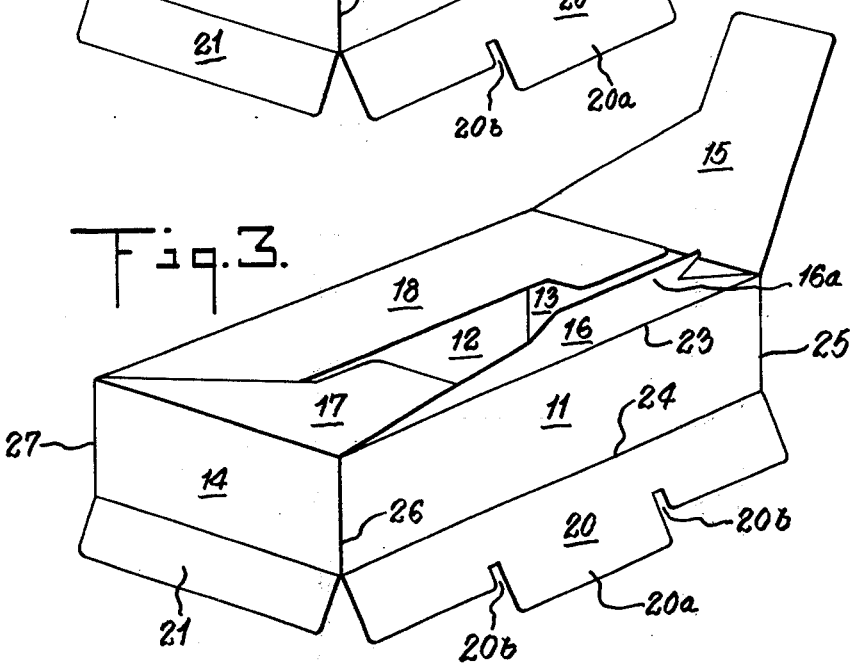
FIG. 3 is a view similar to that of FIG. 2 showing the bottom flaps partially folded.
Figure 4:
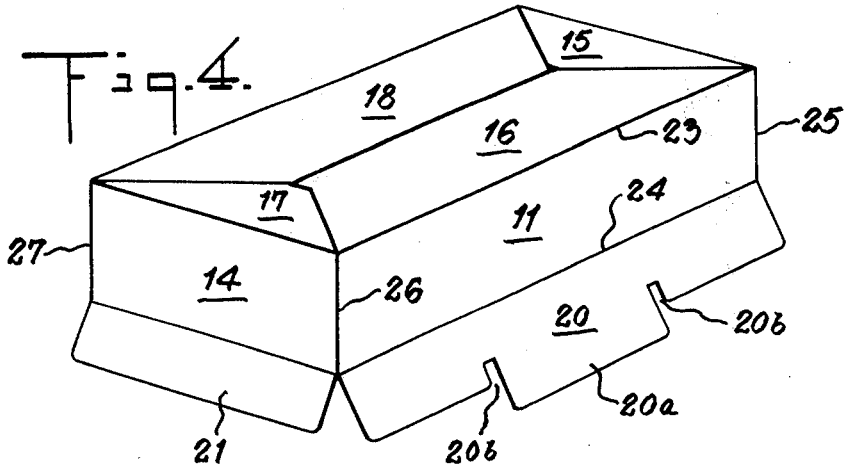
FIG. 4 is a view similar to that of FIG. 3 with all of the bottom flaps folded into place to form the bottom of the tray.

The blank is formed into a tube, usually by the manufacturer, and shipped to the user in flat condition ready for setting up into a tray. FIGS. 2, 3 and 4 illustrate the formation of the bottom by the folding in of the flaps 15, 16, 17 and 18. The contour of these flaps and the formation of this particular type of self-locking bottom is conventional and does not form a part of the present invention. The flap 18 is first folded inward after which the flaps 15 and 17 are superimposed over the flap 18. Flap 16 is then superimposed over the other three flaps and all the flaps are pushed below the horizontal to permit the tongue 16a of the flap 16 to be inserted into the slot formed by the convergence of the edges of the flaps 15, 16 and 17. When all the flaps are moved back to a horizontal position they are locked in place and form a rigid bottom for the container. It will be understood that other forms of self-locking bottoms or bottoms requiring taping or stitching can be used for the container.

After the bottom has been formed, the tray can be filled with mail and closed by folding in the respective top closure flaps 19, 20, 21 and 22. One top flap 20 is narrow, whereas the other top flap 22 is wide and is scored lengthwise along a line 22a to provide a wide panel 22b and a narrow panel 22c. The wide panel 22b is approximately equal in width (between score lines 24 and 22a) to the height of the side panel 12 to which it is attached. The purpose of such construction will be explained hereinafter. For locking the top flaps into place the long edge of the narrow flap 20 has a tongue 20*a* projecting from the center of such edge with slots 20*b* in narrow flap at each end of the tongue 20*a*. The long edge of the narrow panel 22*c* of the wide flap 22 has tabs 22*d* projecting from each end of such long edge slots 22*e* in the narrow panel 22*c* at each inner end of the tabs 22*d*. In forming the closure, the tabs 22*d* are slid over the top of the ends of the flap 20 and the tongue is slid over the top of the center of the narrow panel 22*c*. The slots and tongue on one flap are aligned with the corresponding slots and tabs on the other flap and will come together when the tabs and tongue are slid into place. The slots 22*e* and 20*b* in the flaps are of a depth to permit them to engage and virtually come together when the tongue and tabs are superimposed over the opposite flaps. Such closed tray can now be shipped to another location for further handling and sorting of the mail.

Figure 5:
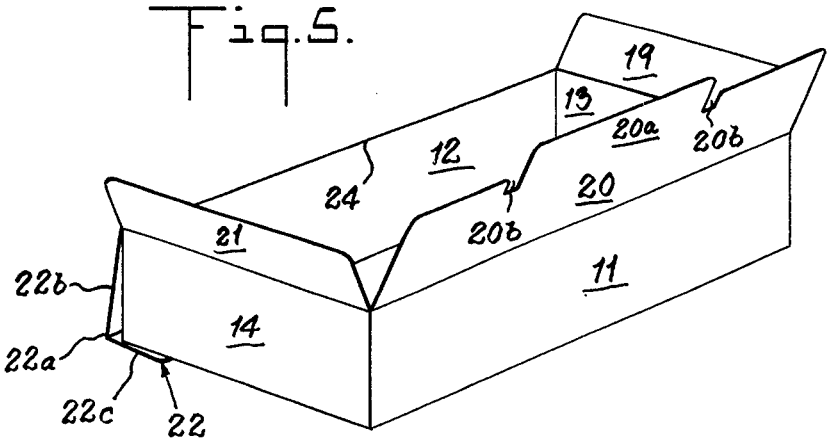
FIG. 5 is a view similar to that of FIG. 4 showing the wide top flap folded downwardly against the side of the tray with the narrow panel of such flap slipped under the bottom of the tray to hold the flap out of the way and to provide unobstructed access to the top of the tray.
Figure 6:
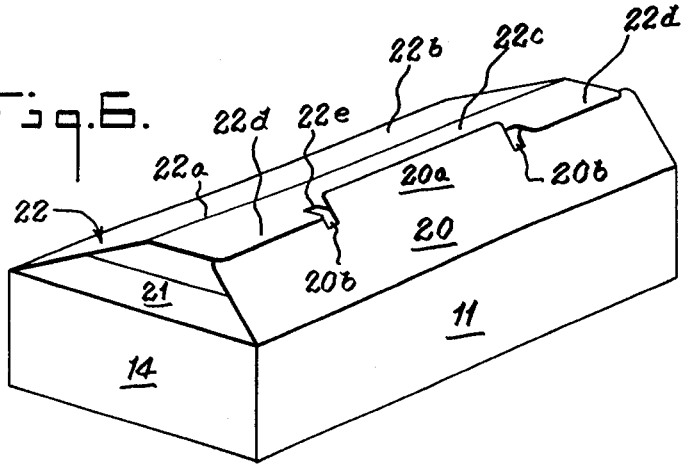
FIG. 6 is a view similar to that of FIG. 5 showing the top flaps partially folded after the container has been filled.
Figure 7:
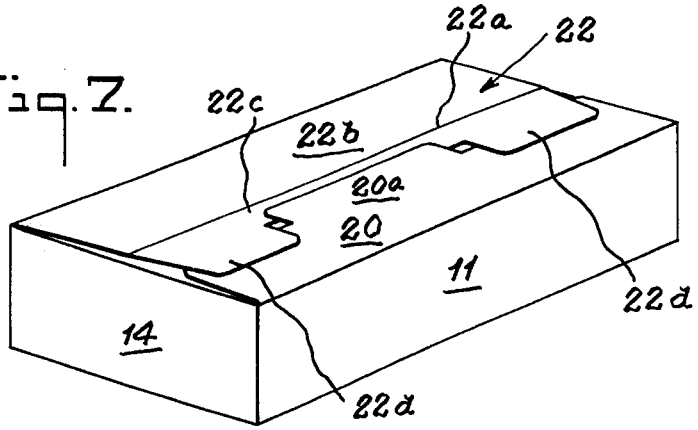
FIG. 7 is a view similar to that of FIG. 6 showing the top flaps folded into place to close the top of the container.

When the filled tray reaches the sorting station, the top flaps are opened and the wide flap 22 is folded outwardly so that the wide panel 22*b* is almost superimposed on the side panel 12. The narrow panel 22*c* is then slipped under the bottom of the tray (FIG. 5). The flap 22 is retained in this position either by the weight of the contents of the tray or by placing the tray against the side of the sorting table. This gives the operator an unobstructed top from which to easily sort the mail in the tray.

Although the tray of the present invention has been described as primarily adapted for handling, shipping and sorting mail, it will be understood that such tray can be used for other purposes where it is advantageous to provide unobstructed access to the top of such tray for reaching or handling the contents of the tray.

Thus among others, the several aforenoted objects and advantages are most effectively attained. Although a somewhat preferred embodiment of the invention has been disclosed and described in detail herein, it should be understood that this invention is in no sense limited thereby and its scope is to be determined by that of the appended claims.

Having thus described the invention, what is claimed is:

1. A tray adapted primarily for handling, shipping and sorting mail comprising opposed side and opposed end panels;

a bottom;

a narrow top closure flap secured to one side panel along a first hinge line; and a wide top closure flap secured to the opposite side panel along a second hinge line;

said narrow and wide top closure flaps being provided with means to lock the flaps in closed position over the tray;

said wide top closure flap being scored along a longitudinal line substantially parallel to the second hinge line to provide a narrow top closure panel along the outer edge of the said flap and a wide top closure panel between the said longitudinal score line and the second hinge line; and said wide top closure panel being approximately equal in width to the height of the side panel to which it is secured;

whereby the said wide top closure flap can be reverse folded to substantially superimpose the wide panel of such flap on its adjacent side panel and to position the narrow panel of such flap under the bottom of the tray so that unobstructed access to the top of the tray is provided for easy sorting of the mail in such tray.

2. A one sheet blank made from a generally rectangular sheet adapted for folding into a tray adapted primarily for handling, shipping and sorting mail comprising a pair of spaced parallel horizontal score lines and spaced parallel score lines normal to the horizontal score lines to provide opposed side and opposed end panels, bottom closure flaps connected to the bottom of said panels and top closure flaps connected to the top of said side panels;

one of said top closure flaps being narrow in width and the other top closure flap being wide;

said wide top closure flap being scored along a longitudinal line substantially parallel to the said horizontal score lines to provide a narrow top closure panel along the outer edge of the said flap and a wide top closure panel between the said longitudinal score line and the top horizontal score line;

said wide top closure panel being approximately equal in width to the height of the side panel to which it is connected whereby when the blank is set up into a tray the said wide top closure panel is reverse folded to substantially superimpose the wide panel of such flap on its adjacent side panel and positions the narrow top closure panel under the bottom of the tray so that unobstructed access to the top of the tray is provided for easy sorting of mail in the tray folded from the blank.

* * * * *